US007676170B2

(12) United States Patent
Hata

(10) Patent No.: US 7,676,170 B2
(45) Date of Patent: Mar. 9, 2010

(54) TONER DENSITY DETECTION APPARATUS AND IMAGE FORMING APPARATUS HAVING THE SAME

(75) Inventor: Shigeo Hata, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 282 days.

(21) Appl. No.: 11/689,408

(22) Filed: Mar. 21, 2007

(65) Prior Publication Data

US 2007/0223954 A1 Sep. 27, 2007

(30) Foreign Application Priority Data

Mar. 22, 2006 (JP) ..... 2006-079589

(51) Int. Cl.
*G03G 15/00* (2006.01)

(52) U.S. Cl. ..... 399/74; 399/49

(58) Field of Classification Search ..... 399/49, 399/60, 64, 72, 74

See application file for complete search history.

(56) References Cited

U.S. PATENT DOCUMENTS 6,853,817 B2 * 2/2005 Suzuki ..... 399/49

FOREIGN PATENT DOCUMENTS

JP 2002-116614 A 4/2002

* cited by examiner

*Primary Examiner*—Hoang Ngo
(74) *Attorney, Agent, or Firm*—Canon USA Inc IP Div

(57) ABSTRACT

A toner density detection apparatus has a sensor unit and a controller. The sensor unit irradiates a toner patch formed on an image carrier with light, splits the light reflected by the toner patch into first and second light components, receives the first and second light components, and outputs first and second light reception signals. The controller causes an analog/digital converter to convert, based on a reference voltage, the output first and second light reception signals into first and second digital data, and detects the density of the toner patch based on the first and second digital data. The toner density detection apparatus adjusts the toner density detection value based on a comparison between a first reference value stored in advance and the first digital data, and a comparison between a second reference value stored in advance and the second digital data.

6 Claims, 8 Drawing Sheets

TONER DENSITY DETECTION APPARATUS AND IMAGE FORMING APPARATUS HAVING THE SAME

BACKGROUND OF THE INVENTION

1. Field of the Invention

The present invention relates to a toner density detection apparatus, e.g., a toner density detection apparatus of an image forming apparatus which forms a color image.

2. Description of the Related Art

Image forming apparatuses of an electrophotographic type, such as a printer and copying machine, execute density adjustment to stabilize the image density. For example, the image forming apparatuses form a pattern image (toner patch) for density measurement on an image carrier such as a photosensitive body or intermediate transfer member, measure the density of the toner patch, and then feedback-control the laser light amount, process high voltage setting, toner replenishing amount, and the like on the basis of the resultant density signal. Japanese Patent Laid-Open No. 2002-116614 proposes a method of measuring the density of a toner patch.

A conventional method of measuring the density of a toner patch will be described with reference to FIGS. 6 and 7.

Referring to FIG. 6, a light emitting element 1 such as an LED irradiates a toner patch 2 formed on an image carrier 12 such as a photosensitive body or intermediate transfer belt with light. A patch sensor unit 11 includes a polarization beam splitter 3 inserted in the optical path of the light reflected by the toner patch 2, and receiving units 4 and 5 for receiving the s-polarized light (s wave) and p-polarized light (p wave) having passed through the polarization beam splitter 3. The patch sensor unit 11 includes amplifiers 6 and 7. The amplifier 6 amplifies a signal corresponding to the light amount of p-polarized light output from the receiving unit 5 with a predetermined gain, and sends the amplified signal to the subsequent stage. The amplifier 7 amplifies a signal corresponding to the light amount of s-polarized light output from the receiving unit 4 with a predetermined gain, and sends the amplified signal to the subsequent stage. In this manner, the light amounts of two different light components (p-polarized light and s-polarized light) of the light reflected by the toner patch 2 can be independently calculated.

FIG. 7 is a circuit diagram of the receiving units 4 and 5. A variable resistor VR is operated to change a combined resistance (the combined resistance of the resistors VR and R) R' of the cathode terminal of a receiving element PS and output terminal of the circuit, thus allowing gain adjustment of an operation amplifier OP. The output voltage is expressed by ($I \times R' + k \times Voff$), where k is the amplification factor or gain defined by the operation amplifier OP and the variable resistor VR. With this circuit arrangement, the variable resistor VR is adjusted by P and S waves at the time of measurement of a density of the toner patch. This makes it possible to measure the density of a toner patch within a predetermined accuracy.

Referring back to FIG. 6, the signal sent through the amplifier 6 or 7 is input to a controller 10. The amplifier 6 or 7 connects to the input of an A/D converter 8 or 9. The analog signal sent through the amplifier 6 or 7 is converted into digital data by the A/D converter 8 or 9. The controller 10 recognizes detection of the density of the toner patch. In the A/D converters 8 and 9, a Ref voltage 13 is an upper limit.

The prior art disclosed in Japanese Patent Laid-Open No. 2002-116614 executes gain adjustment while the amplifier, which amplifies a signal of an S wave having a narrow dynamic range, has a higher gain than that of the amplifier which amplifies a signal of a P wave having a wide dynamic range.

Since the amplifier is normally formed from an analog circuit, it has low latitude (allowable range) for the environmental characteristic to obtain a sufficient accuracy of amplification factor. The accuracy is deteriorated by a temporal change. As described above, gain adjustment is performed using the variable resistor VR so that the output signal of P or S wave at the time of measurement of the density of the toner that is formed based on a signal with a predetermined density level. Such gain adjustment requires manual operation over a long time and therefore leads to a variation in adjustment.

For these reasons, toner density measurement accuracy sometimes does not have a sufficient accuracy.

SUMMARY OF THE INVENTION

The present invention is directed to a toner density detection apparatus which can improve the operability and detection accuracy in adjustment even if the change of the environmental characteristic or the temporal change occurs, and an image forming apparatus incorporating the same.

A toner density detection apparatus according to one aspect of the present invention includes a sensor unit configured to irradiate a pattern image for density measurement formed on an image carrier with light, split the light reflected by the pattern image into a first light component and a second light component, receive the first light component and the second light component, and output a first light reception signal and a second light reception signal; an analog/digital converter configured to convert, based on a reference voltage, the first light reception signal and second light reception signal output from the sensor unit into first digital data and second digital data; a density detection unit configured to detect a density of the pattern image based on the first digital data and the second digital data; and an adjusting unit configured to adjust the toner density detection value detected by the density detection unit, based on a comparison between a first reference value stored in correspondence with the density of the pattern image in advance and the first digital data, a comparison between a second reference value stored in correspondence with the density of the pattern image in advance and the second digital data.

An image forming apparatus according to another aspect of the present invention includes a toner density detection apparatus configured to detect a density of a pattern image for density measurement formed on an image carrier and to execute density control based on a density level of image data to form the pattern image and a density of the detected pattern image. The toner density detection apparatus includes a sensor unit configured to irradiate the pattern image formed on the image carrier with light, split the light reflected by the pattern image into a first light component and a second light component, receive the first light component and the second light component, and output a first light reception signal and a second light reception signal; an analog/digital converter configured to convert, based on a reference voltage, the first light reception signal and second light reception signal output from the sensor unit into first digital data and second digital data; a density detection unit configured to detect the density of the pattern image based on the first digital data and the second digital data; and an adjusting unit configured to adjust the toner density detection value detected by the density detection unit, based on a comparison between a first reference value stored in correspondence with the density of the pattern image in advance and the first digital data, and a comparison between a second reference value stored in correspondence with the density of the pattern image in advance and the second digital data.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENT

An embodiment of the present invention will be described in detail below with reference to the accompanying drawings. In the present embodiment, the arrangement of a toner density detection apparatus will be mainly explained. The present invention improves the accuracy of density adjustment in an image forming apparatus to which the toner density detection apparatus is applied, or shortens the adjustment time in the image forming apparatus. Therefore, the present invention also incorporates the image forming apparatus.

<Arrangement Example of Image Forming Apparatus According to the Present Embodiment>

(Arrangement Example of Image Forming Unit in Image Forming Apparatus)

Figure 8:
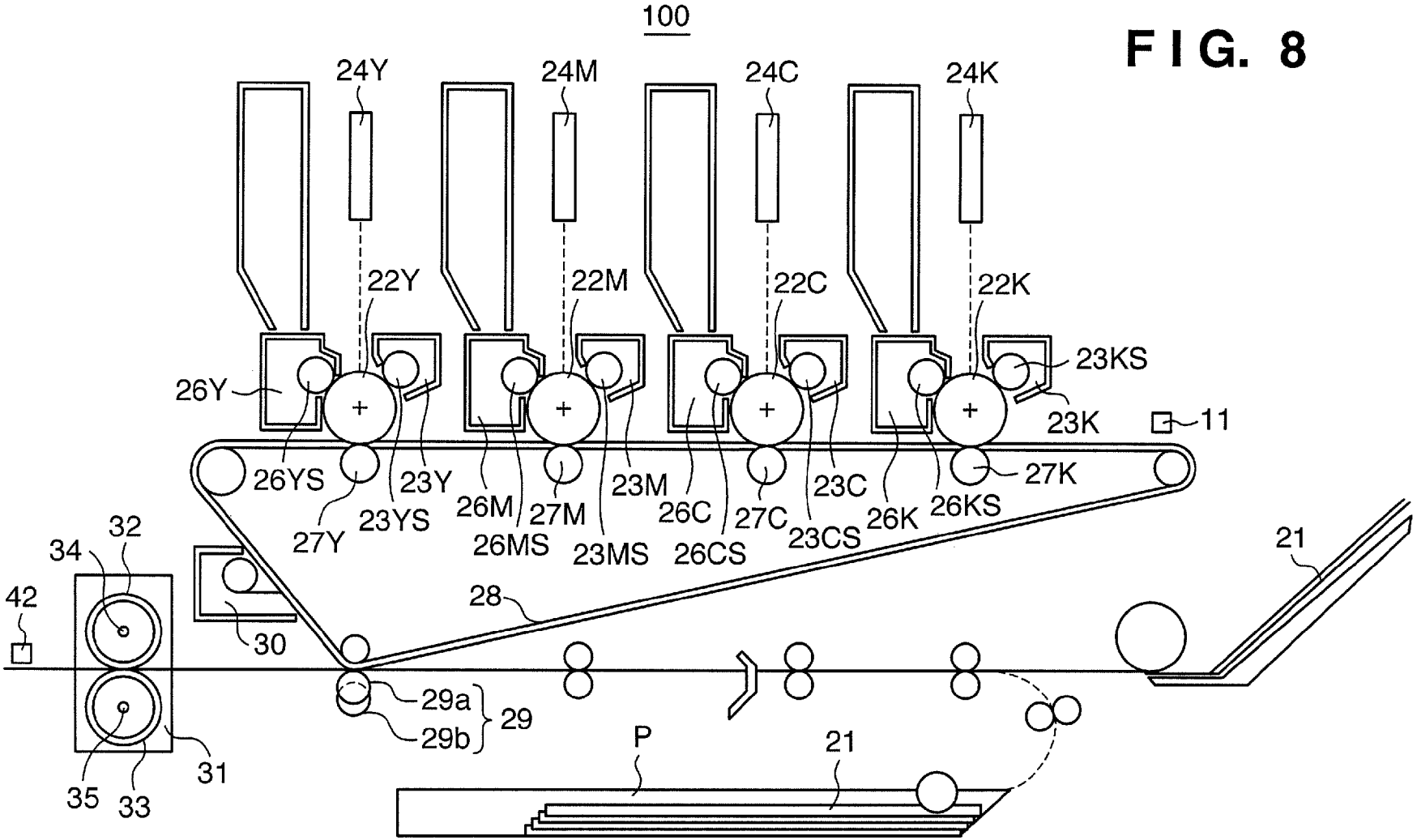
FIG. 8 is a sectional view of an image forming unit of an image forming apparatus according to the present invention.

FIG. 8 is a sectional view of an image forming unit 100 in an image forming apparatus incorporating the present invention. As shown in FIG. 8, the image forming apparatus is a color image forming apparatus of a tandem system that adopts an intermediate transfer member 28. The operation of the image forming unit 100 in the color image forming apparatus of an electrophotographic type will be explained with reference to FIG. 8.

The image forming unit 100 forms an electrostatic latent image on a photosensitive drum with exposure light modulated on the basis of an image signal processed by an image processing unit. The image forming unit 100 forms a single-color toner image by developing the electrostatic latent image at the station of each color, and forms a multicolor toner image by superimposing the developed single-color toner images on the intermediate transfer member 28. The image forming unit 100 transfers the multicolor toner image onto a printing medium, and fixes the multicolor toner image on the printing medium.

For the respective stations of yellow (Y), magenta (M), cyan (C), and black (K), the image forming unit 100 includes injection chargers 23Y, 23M, 23C, and 23K serving as charging units for charging photosensitive bodies 22Y, 22M, 22C, and 22K. The injection chargers 23Y, 23M, 23C, and 23K include sleeves 23YS, 23MS, 23CS, and 23KS.

The circumferential outer surface of an aluminum cylinder of each of the photosensitive bodies 22Y, 22M, 22C, and 22K can be coated with an organic conductive layer so that the photosensitive bodies 22Y, 22M, 22C, and 22K rotate upon receiving the driving force of a driving motor (not shown). The driving motor rotates the photosensitive bodies 22Y, 22M, 22C, and 22K counterclockwise in accordance with the image formation operation.

The image forming unit 100 causes scanner units 24Y, 24M, 24C, and 24K serving as exposure units to irradiate the photosensitive bodies 22Y, 22M, 22C, and 22K with exposure light to expose the surfaces of the photosensitive bodies 22Y, 22M, 22C, and 22K. This forms electrostatic latent images on the photosensitive bodies 22Y, 22M, 22C, and 22K.

The image forming unit 100 includes developing units 26Y, 26M, 26C, and 26K for developing (visualizing) the electrostatic latent images of yellow (Y), magenta (M), cyan (C), and black (K) for the respective stations. The developing units 26Y, 26M, 26C, and 26K include sleeves 26YS, 26MS, 26CS, and 26KS. The developing units 26Y, 26M, 26C, and 26K can be detachable.

The image forming unit 100 includes primary transfer rollers 27Y, 27M, 27C, and 27K serving as transfer devices which rotate clockwise in FIG. 8. The primary transfer rollers transfer the single-color toner images from the photosensitive bodies 22Y, 22M, 22C, and 22K onto the intermediate transfer member 28. The single-color toner images are transferred onto the intermediate transfer member 28 as the primary transfer rollers 27Y, 27M, 27C, and 27K opposing the photosensitive bodies 22Y, 22M, 22C, and 22K rotate. This operation is called a primary transfer.

The transfer device superimposes the single-color toner images on the intermediate transfer member 28 for the respective stations, and conveys the superimposed multicolor toner image to a secondary transfer roller 29 as the intermediate transfer member 28 rotates. The transfer device transfers the multicolor toner image on the intermediate transfer member 28 onto a printing medium P conveyed from a paper feed tray 21 to a secondary transfer roller 29. More specifically, an appropriate bias voltage is applied to the secondary transfer roller 29 to electrostatically transfer the toner image onto the printing medium P. This operation is called a secondary transfer. The secondary transfer roller 29 abuts against the printing medium P at a position 29*a* while the secondary transfer roller transfers the multicolor toner image onto the printing medium P. The secondary transfer roller 29 separates from the printing medium P to a position 29*b* after the end of transfer.

The image forming unit 100 includes a fixing apparatus 31 for fixing by melting the multicolor toner image transferred onto the printing medium P on the printing medium P. The fixing apparatus 31 includes a fixing roller 32 for heating the printing medium P and a pressurizing roller 33 for bringing the printing medium P into press contact with the fixing roller 32. The fixing roller 32 and pressurizing roller 33 can have a hollow shape to accommodate heaters 34 and 35. The fixing apparatus 31 causes the fixing roller 32 and the pressurizing roller 33 to convey the printing medium P holding the multicolor toner image on it, and to fix the multicolor toner image on the printing medium P by applying heat and pressure.

A discharge roller (not shown) discharges the printing medium P after toner fixing to a paper discharge tray (not shown). The image formation operation ends.

A cleaning device 30 cleans the toner remaining on the intermediate transfer member 28. A cleaner container stores the waste toner produced after transferring the four-color, i.e., multicolor toner image formed on the intermediate transfer member 28 onto the printing medium P.

A patch sensor unit (density sensor) 11 according to this embodiment is disposed so as to oppose the intermediate transfer member 28 in the color image forming apparatus. The patch sensor unit measures the density of the toner patch formed on the surface of the intermediate transfer member 28. The measurement result obtained by the patch sensor unit 11 is used for correction of single-color density (tone characteristics) of cyan (C), magenta (M), yellow (Y), and black (K). The patch sensor unit 11 includes an IC (not shown) for processing light reception data and a holder (not shown) for accommodating the IC.

On the conveyance path of the printing medium P, a color sensor 42 is disposed downstream of the fixing apparatus 31 so as to oppose the image forming surface of the printing medium P. The color sensor 42 detects the color of the image formed and fixed on the printing medium P, and outputs an RGB value. Providing the color sensor 42 in the color image forming apparatus makes it possible to automatically detect the color of the fixed image in the image forming unit 100.

(Arrangement Example of Toner Density Detection Apparatus)

Figure 1:
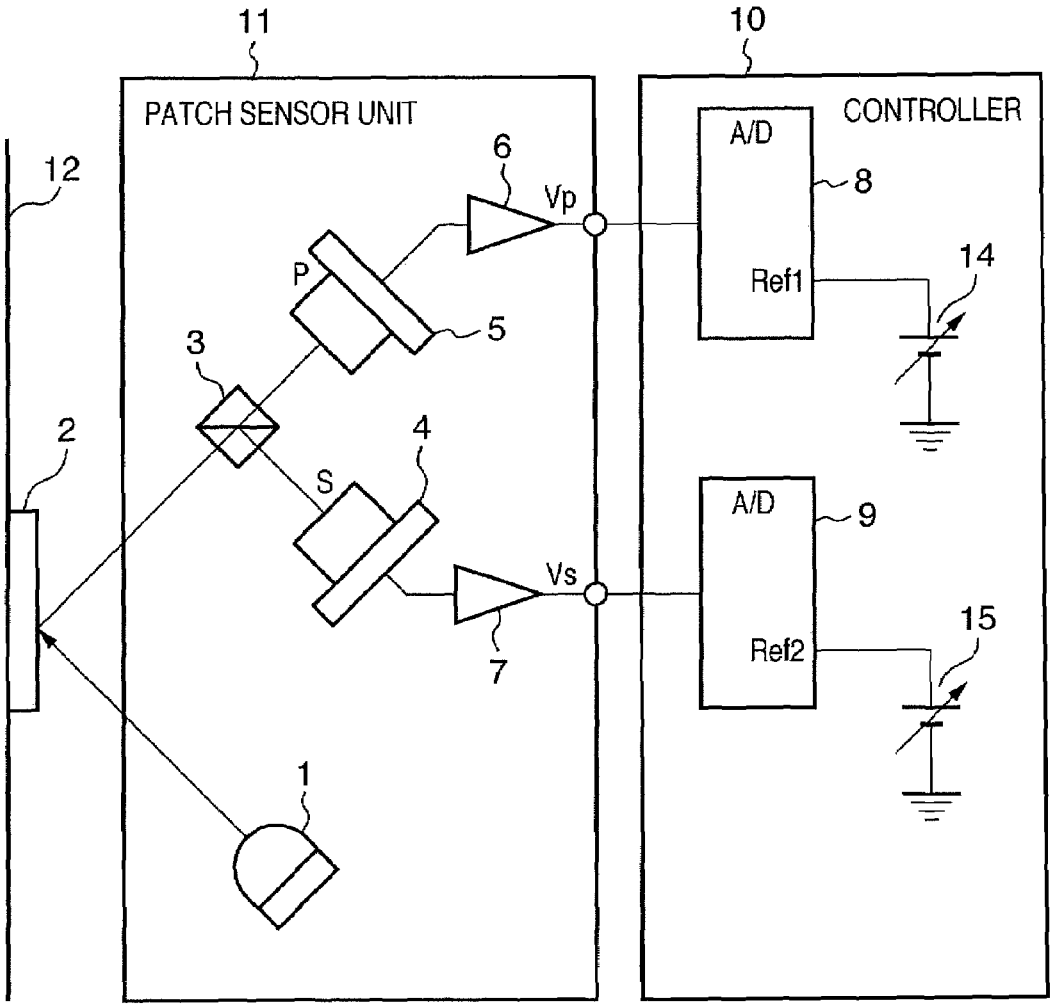
FIG. 1 is a view of a toner density detection apparatus.

FIG. 1 is a view of a toner density detection apparatus.

Referring to FIG. 1, a light emitting element 1, such as an LED, irradiates a toner patch 2 formed on an image carrier 12, such as a photosensitive body or intermediate transfer belt, with light. The patch sensor unit 11 can include a polarization beam splitter 3 disposed in the optical path of the light reflected by the toner patch 2, and receiving units 4 and 5 for receiving the s-polarized light (s wave) and the p-polarized light (p wave) split by the polarization beam splitter 3. The patch sensor unit 11 can include amplifiers 6 and 7. The amplifier 6 amplifies a signal corresponding to the amount of p-polarized light output from the receiving unit 5 with a predetermined gain, and sends the amplified signal to the subsequent stage. The amplifier 7 amplifies a signal corresponding to the amount of s-polarized light output from the receiving unit 4 with a predetermined gain, and sends the amplified signal to the subsequent stage. In this manner, the light amounts of two different light components (p-polarized light and s-polarized light) of the light reflected by the toner patch 2 can be independently calculated.

The signal sent through the amplifier 6 or 7 is input to a controller 10. The amplifier 6 or 7 connects to the input of an A/D converter 8 or 9. The analog signal sent through the amplifier 6 or 7 is converted into digital data by the A/D converter 8 or 9. The A/D converters 8 and 9 perform conversion to digital data by Ref voltages 14 and 15 as upper limit, which are variable under the control of the controller 10. The converted digital data is recognized by the controller 10 as the toner patch density.

Figure 7:
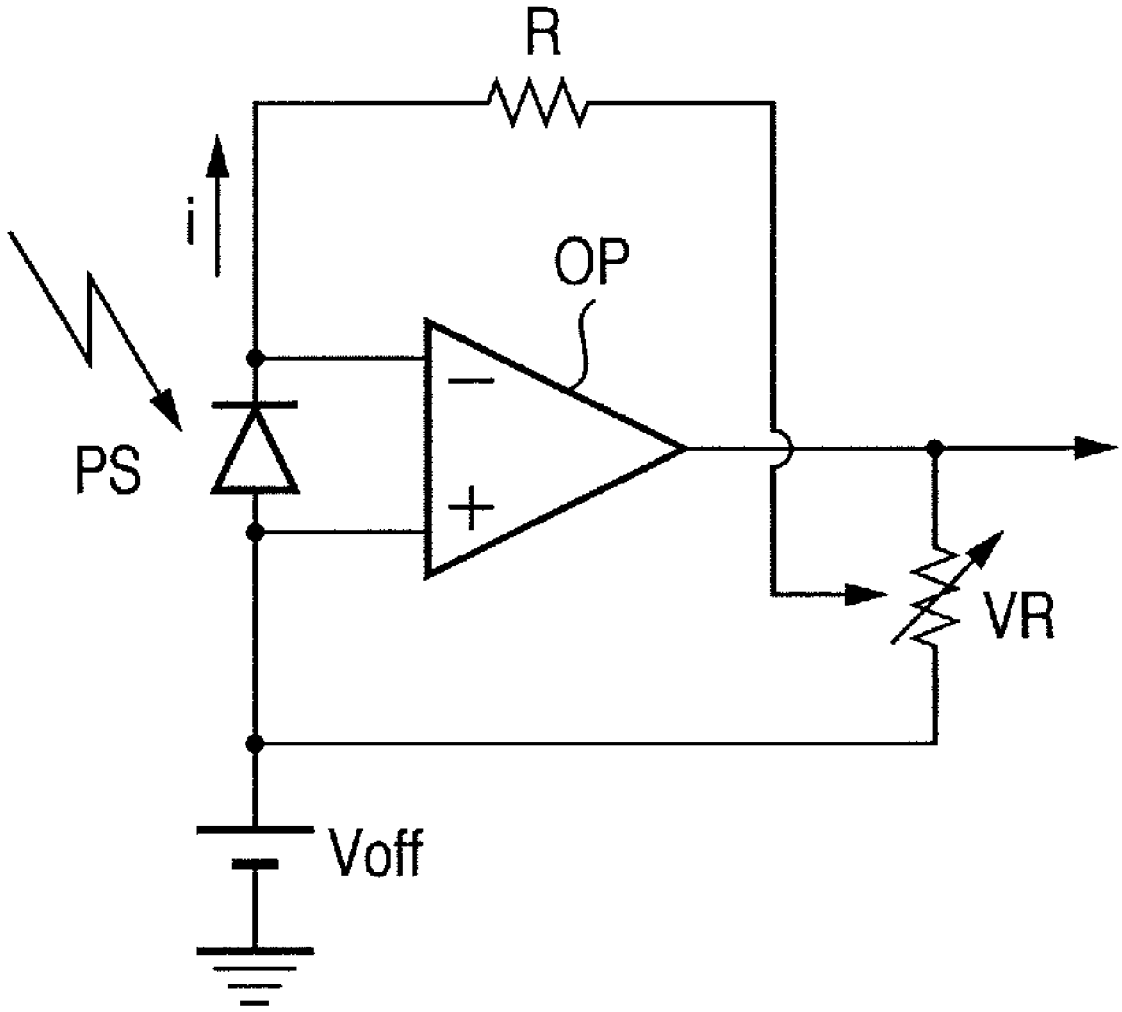
FIG. 7 PRIOR ART
FIG. 7 is a circuit diagram of a receiving unit of the conventional toner density detection apparatus shown in FIG. 6.

The circuit arrangements of the receiving units 4 and 5 are the same as that shown in FIG. 7 of the prior art.

(Arrangement Example of Controller 10)

Figure 2:
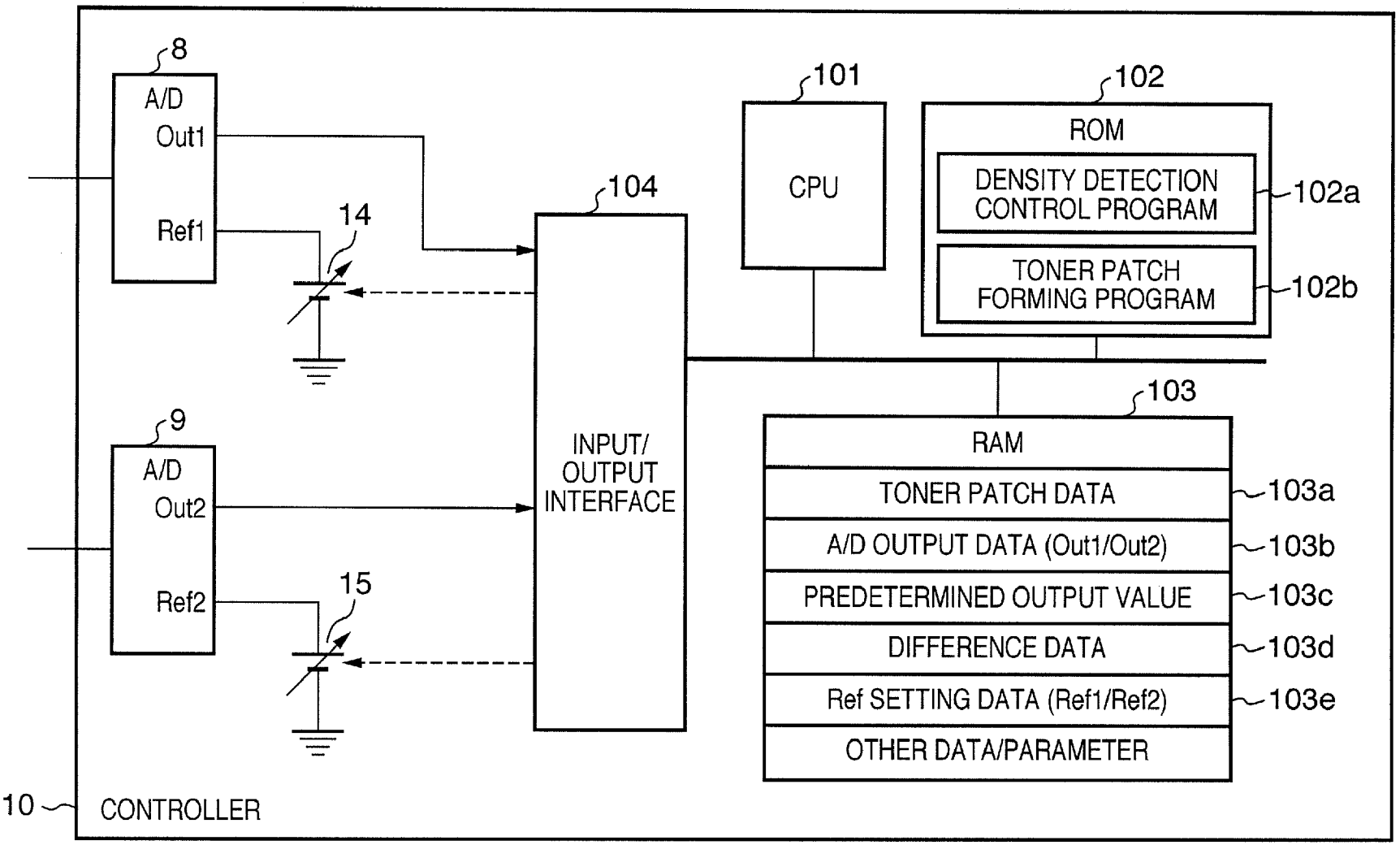
FIG. 2 is a block diagram of a controller of the toner density detection apparatus shown in FIG. 1.

FIG. 2 is a block diagram showing the controller 10. Note that arrangements which have no direct relation with this embodiment, e.g., arrangements related to image forming processing and arrangements related to sheet convey processing are omitted in FIG. 2. The same reference numerals as in FIG. 1 denote the same constituent components in FIG. 2.

Reference numeral 101 denotes a CPU for arithmetic operation control. The CPU 101 may be dedicated to density detection processing, or may control the entire image forming apparatus, the entire image forming unit 100, or part of the image forming unit 100.

Reference numeral 102 denotes a ROM which stores a program to be executed by the CPU 101. The ROM 102 stores a density detection control program 102*a* and a toner patch forming program 102*b* for controlling the image forming unit 100 as programs related to this embodiment.

Reference numeral 103 denotes a RAM which temporarily stores data associated with control of the CPU 101. The RAM 103 stores, as data related to this embodiment, predetermined toner patch data 103*a* and A/D output data (Out1/Out2) 103*b* as the output from the A/D converter. The RAM 103 further stores a predetermined output value 103*c* as a target density value of image formation by the toner patch data 103*a*, and difference data 103*d* as a difference value between the A/D output data (Out1/Out2) 103*b* and the predetermined output value 103*c*. The RAM 103 further stores Ref setting data (Ref1/Ref2) 103*e* for setting the difference data 103*d* to zero. Storing the Ref setting data 103*e* as a table based on the difference data 103*d* allows prompt adjustment of the Ref1/Ref2.

The ROM 102 may store fixed data to be stored in the RAM 103.

Reference numeral 104 denotes an input/output interface which interfaces data of the controller with the A/D output and Ref voltage control input. Note that other interfaces such as interfaces with other CPUs and a display unit/operation unit are omitted in FIG. 2.

<Operation Example of Image Forming Apparatus According to This Embodiment>

The operation of the image forming apparatus according to this embodiment, especially, the operation of the toner density detection apparatus will be explained below.

Figure 3:
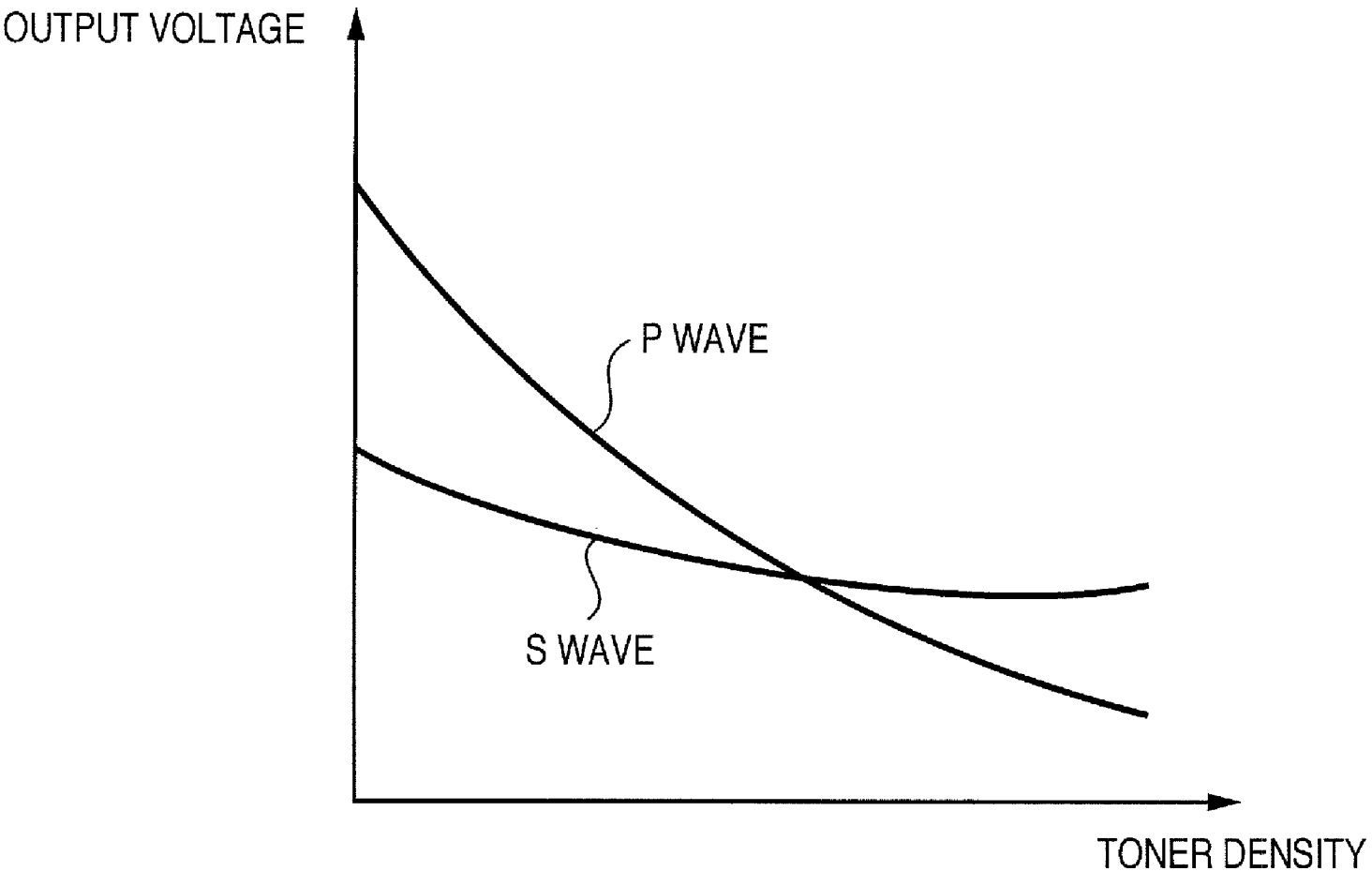
FIG. 3 is a conceptual graph of an example output signal from a patch sensor unit of the toner density detection apparatus shown in FIG. 1.

FIG. 3 is a conceptual graph showing an example of the output signal from the patch sensor unit 11 of the toner density detection apparatus. FIG. 3 shows the schematic characteristics of P and S waves. The controller 10 detects the density on the basis of relational expression: density=P wave signal−m×S wave signal (where m is a coefficient set for each color) from the characteristics shown in FIG. 3.

(First Adjustment Example of Toner Density Detection Apparatus)

Figure 4:
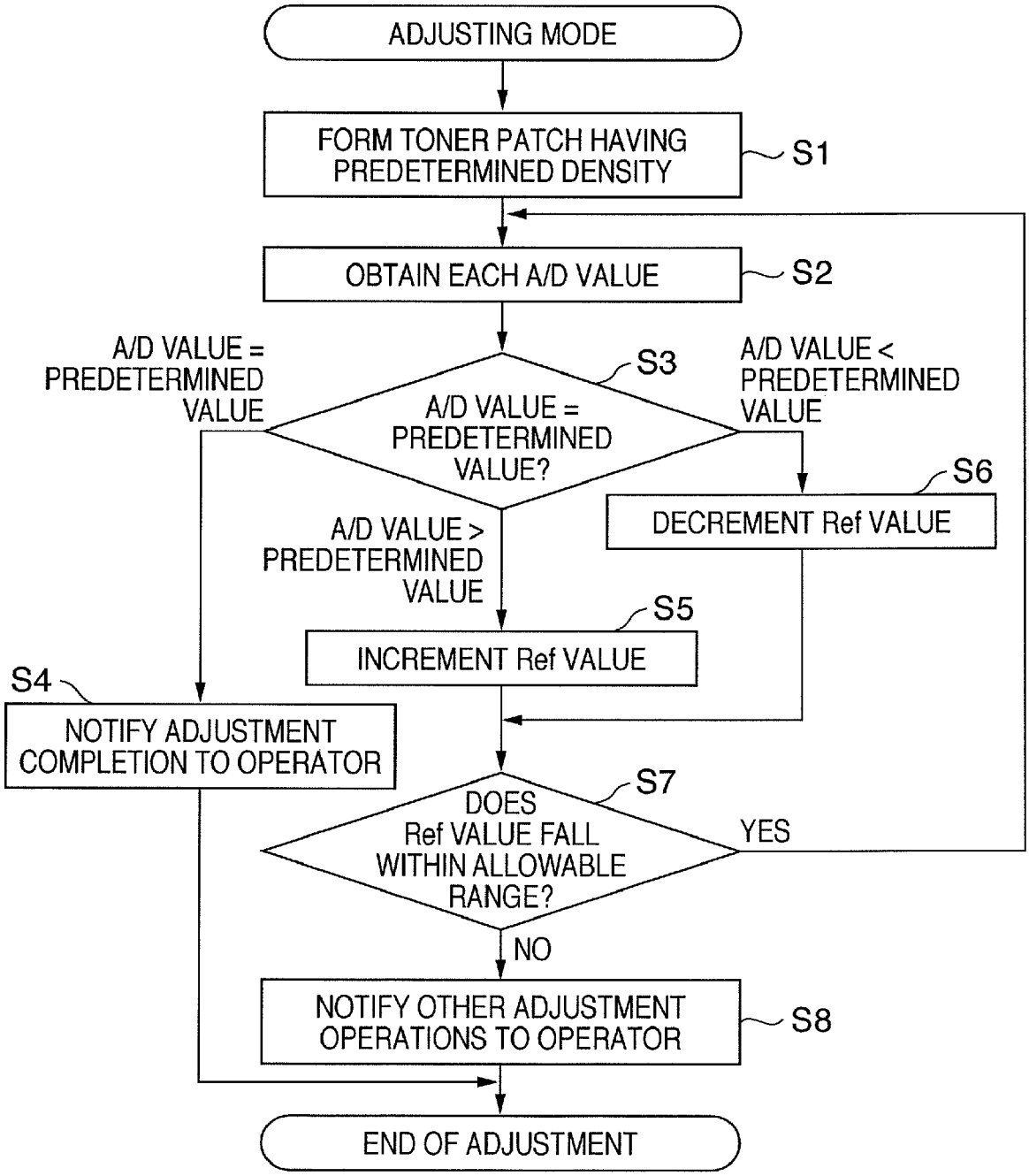
FIG. 4 is a flowchart for explaining the operation of the controller of the toner density detection apparatus shown in FIG. 1.

The operation of the patch sensor unit 11 in an adjusting mode will be explained with reference to the flowchart shown in FIG. 4. The CPU 101 executes the flowchart shown in FIG. 4 according to the program stored in the ROM 102. A shift to the adjusting mode is normally made before density control, e.g., under a condition in which every time a predetermined period of time elapses or every time a predetermined number of sheets are printed, or when, e.g., powering on or resetting the apparatus. However, the adjusting mode is not limited to this.

When a shift to the adjusting mode is made, the CPU 101 forms a toner patch 2 having a predetermined density on the image carrier 12, such as a photosensitive body or intermediate transfer belt, in step S1. In step S2, the CPU 101 obtains the A/D value of each of P wave and S wave at the time of reading the toner patch 2 by the patch sensor unit 11. The CPU 101 adjusts the Ref voltages 14 and 15 so that the A/D value obtained in step S2 becomes predetermined data. More specifically, in step S3, the CPU 101 compares the A/D value obtained in step S2 with a predetermined value stored in correspondence with the toner patch 2 in advance. As shown in the flowchart of FIG. 4, the process branches into three in accordance with the comparison result.

If the A/D value obtained in step S2 is equal to the predetermined value, the CPU 101 notifies the adjustment completion to the operator by an operation display unit (not shown) in step S4, and the adjustment of the patch sensor unit 11 ends.

If the A/D value obtained in step S2 is larger than the predetermined value, the CPU 101 increments the Ref value in step S5. If the A/D value obtained in step S2 is smaller than the predetermined value, the CPU 101 decrements the Ref value in step S6.

The CPU 101 determines in step S7 whether the Ref value falls within an allowable range. If the Ref value falls within the allowable range, the process returns to step S2 and the CPU 101 continues the adjustment of the Ref value. If the Ref value falls outside the allowable range, the CPU 101 notifies other adjustment operations such as adjustment of the variable resistor VR shown in FIG. 7 and replacement of the sensor to the operator by the operation display unit (not shown), in step S8. The adjustment of the patch sensor unit 11 ends.

(Second Adjustment Example of Toner Density Detection Apparatus)

In the first adjustment example, the variable power supply source 14 or 15 changes the Ref voltage of the A/D converter 8 or 9. In the second adjustment example, however, the same effect and reduction in cost can be attained at the same time even without such a change means.

Figure 5:
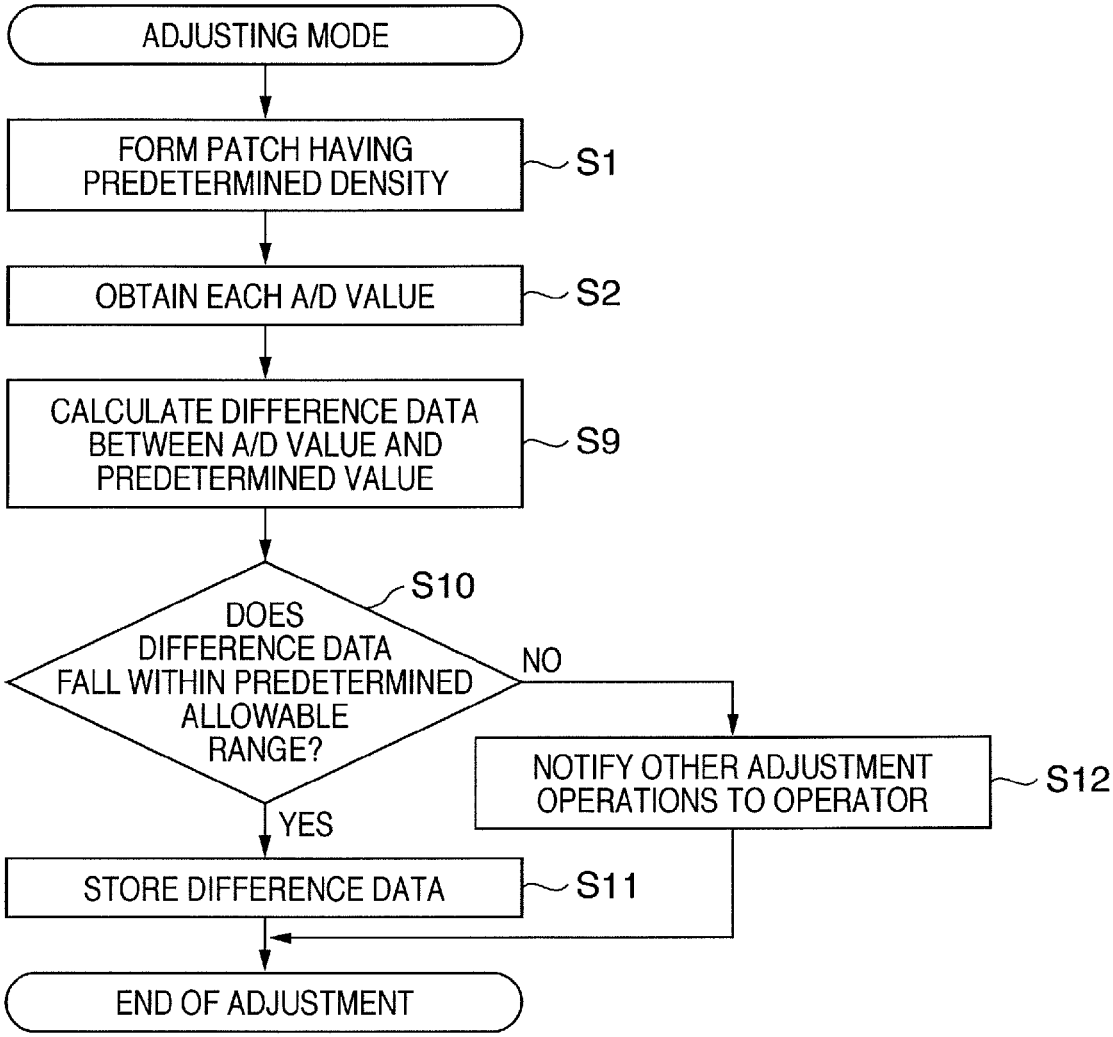
FIG. 5 is a flowchart for explaining another operation of the controller of the toner density detection apparatus shown in FIG. 1.
Figure 6:
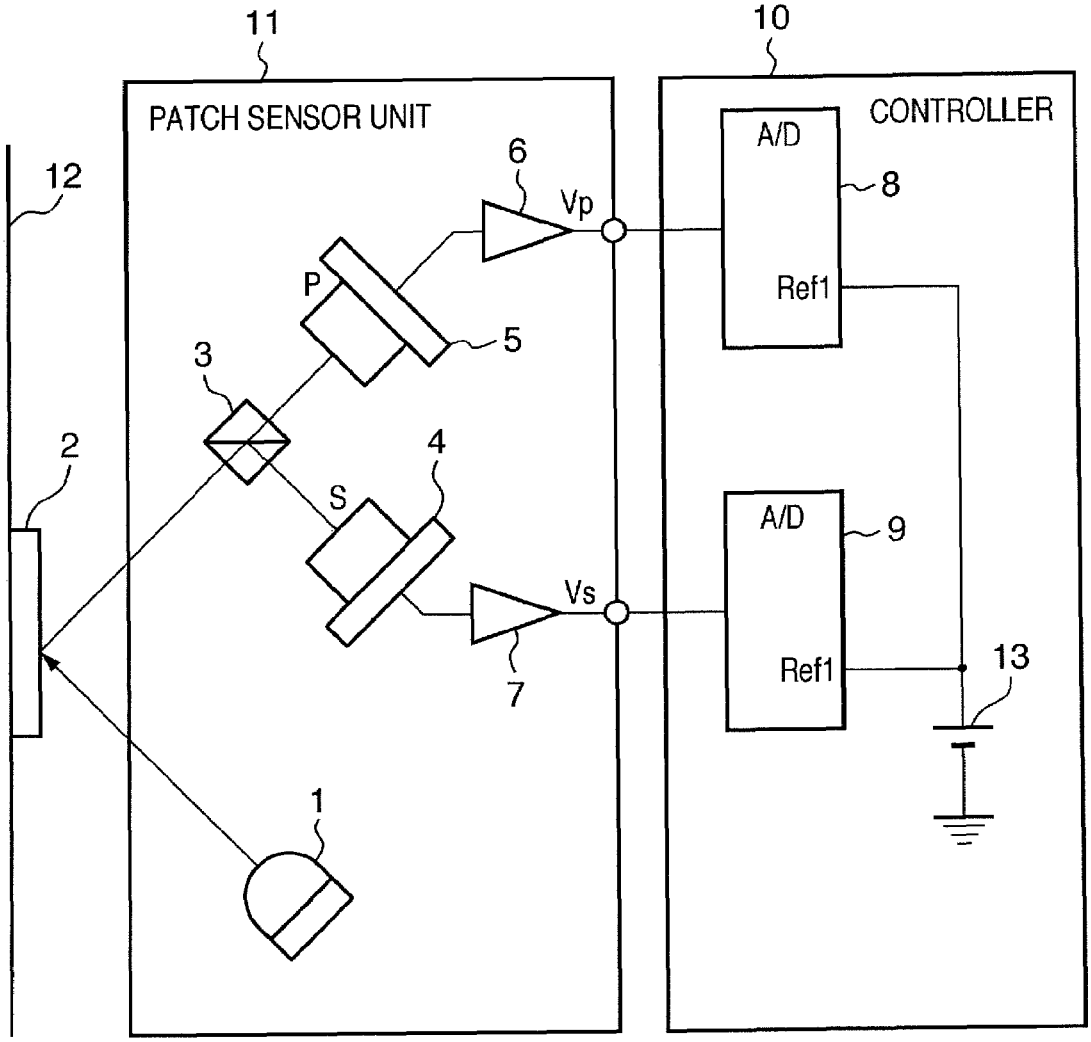
FIG. 6 PRIOR ART
FIG. 6 is a view of a conventional toner density detection apparatus.

The adjusting mode of the patch sensor unit 11 will be explained with reference to the flowchart shown in FIG. 5.

When a shift to the adjusting mode is made, the CPU 101 forms a toner patch 2 having a predetermined density on the image carrier 12, such as a photosensitive body or intermediate transfer belt, in step S1. In step S2, the CPU 101 obtains the A/D value of each of P wave and S wave at the time of reading the toner patch 2 by the patch sensor unit 11. The CPU 101 calculates a difference data between a predetermined value and the measured A/D value in step S9. The CPU 101 determines in step S10 whether the difference data falls within a predetermined allowable range within which the difference data does not have any adverse effect on density detection. If the difference data falls within the predetermined allowable range, the CPU 101 stores the difference data in the RAM 103 in step S11. If the difference data falls outside the predetermined allowable range, the CPU 101 notifies other adjustment operations including adjustment in the first adjustment example, adjustment of the variable resistor VR shown in FIG. 7, and replacement of the sensor in step S12, to the operator by the operation display unit (not shown), and adjustment ends.

When adjustment is complete, the CPU 101 shifts to an actual operation mode. In the actual operation mode, a value obtained by correcting the measurement data of the A/D output using the correction data saved in step S11 is dealt as a measurement value.

Executing these adjustment processes a number of times makes it possible to further improve the detection accuracy.

As described above, the present invention can improve the latitude for the environmental characteristic, accuracy, and temporal change, and can correct both the sensor and receiving-side circuit in adjustment to improve the operability and detection accuracy in adjustment, thus allowing an improvement in density measurement accuracy.

The present invention may be applied to a system constituted by a plurality of devices (e.g., a computer, an interface device, a reader, a printer, and the like) or an apparatus comprising a single device (e.g., a copying machine, a printer, a facsimile apparatus, or the like).

The present invention can be achieved even by causing the computer of the system or apparatus to read out program codes for implementing the functions of the above-described embodiment from a storage medium and execute the program codes.

In this case, the program codes read out from the storage medium implement the functions of the above-described embodiment by themselves, and the storage medium which stores the program codes constitutes the present invention.

As a storage medium to supply the program codes, for example, a floppy® disk, hard disk, optical disk, magnetooptical disk, CD-ROM, CD-R, magnetic tape, nonvolatile memory card, or ROM can be used.

The functions of the above-described embodiment are implemented not only when the readout program codes are executed by the computer but also when the operating system (OS) running on the computer performs part or all of actual processing on the basis of the instructions of the program codes.

The program codes read out from the storage medium are written in the memory of a function expansion board inserted into the computer or a function expansion unit connected to the computer. After that, the functions of the above-described embodiment are implemented when the CPU of the function expansion board or function expansion unit performs part or all of actual processing on the basis of the instructions of the program codes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-079589 filed on Mar. 22, 2006, which is hereby incorporated by reference herein in its entirety.

What is claimed is:

1. A toner density detection apparatus comprising:

a sensor unit configured to irradiate a pattern image for density measurement formed on an image carrier with light, split the light reflected by the pattern image into a first light component and a second light component, receive the first light component and the second light component, and output a first light reception signal and a second light reception signal;

an analog/digital converter configured to convert, based on a first reference voltage for determining an upper limit of an analog signal to be converted, the first light reception signal output from the sensor unit into first digital data, and convert, based on a second reference voltage for determining an upper limit of an analog signal to be converted, second light reception signal output from the sensor unit into second digital data;

a reference voltage generation unit configured to generate the first reference voltage and the second reference voltage;

a density detection unit configured to detect a density of the pattern image based on the first digital data and the second digital data; and an adjusting unit configured to adjust the first reference voltage generated by the reference voltage generation unit so that the first digital data becomes a first predetermined value and adjust the second reference voltage generated by the reference voltage generation unit so that the second digital data becomes a second predetermined value, when a pattern image having a predetermined density is irradiated in an adjusting mode.

2. The apparatus according to claim 1, wherein the adjusting unit increments the first reference voltage if the first digital data is larger than the first predetermined value, decrements the first reference voltage if the first digital data is smaller than the first predetermined value, increments the second reference voltage if the second digital data is larger than the second predetermined value, and decrements the second reference voltage if the second digital data is smaller than the second predetermined value.

3. The apparatus according to claim 1, wherein the sensor unit includes:

a light irradiation unit operable to irradiate the pattern image formed on the image carrier with light;

a light splitting unit configured to split the light reflected by the pattern image into the first light component and the second light component;

a first receiving unit configured to receive the first light component from the light splitting unit and detect a light amount of the first light component;

a second receiving unit configured to receive the second light component from the light splitting unit and detect a light amount of the second light component;

a first amplifier configured to amplify the signal from the first receiving unit and output the first light reception signal; and a second amplifier configured to amplify the signal from the second receiving unit and output the second light reception signal.

4. The apparatus according to claim 3, wherein the first receiving unit and the second receiving unit include a gain adjusting unit configured to adjust a gain in light amount detection.

5. An image forming apparatus comprising a toner density detection apparatus configured to detect a density of a pattern image for density measurement formed on an image carrier and to execute density control based on a density level of image data to form the pattern image and a density of the detected pattern image, the toner density detection apparatus including:

a sensor unit configured to irradiate the pattern image formed on the image carrier with light, split the light reflected by the pattern image into a first light component and a second light component, receive the first light component and the second light component, and output a first light reception signal and a second light reception signal;

an analog/digital convener configured to convert, based on a first reference voltage for determining an upper limit of an analog signal to be converted, the first light reception signal output from the sensor unit into first digital data, and convert, based on a second reference voltage for determining an upper limit of an analog signal to be converted, second light reception signal output from the sensor unit into second digital data;

a reference voltage generation unit configured to generate the first reference voltage and the second reference voltage;

a density detection unit configured to detect the density of the pattern image based on the first digital data and the second digital data; and an adjusting unit configured to adjust the first reference voltage generated by the reference voltage generation unit so that the first digital data becomes a first predetermined value and adjust the second reference voltage generated by the reference voltage generation unit so that the second digital data becomes a second predetermined value, when a pattern image having a predetermined density is irradiated in an adjusting mode.

6. The apparatus according to claim 1, wherein the adjusting unit gives notification of a warning when the first reference voltage or the second reference voltage to be adjusted does not fall within a predetermined allowable range.

* * * * *